US007032552B2

(12) United States Patent
Schäfer et al.

(10) Patent No.: US 7,032,552 B2
(45) Date of Patent: Apr. 25, 2006

(54) CAMSHAFT ADJUSTER WITH AN ELECTRICAL DRIVE

(75) Inventors: Jens Schäfer, Herzogenaurach (DE); Martin Steigerwald, Erlangen (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/979,487

(22) Filed: Nov. 2, 2004

(65) Prior Publication Data

US 2005/0061278 A1 Mar. 24, 2005

Related U.S. Application Data

(63) Continuation of application No. PCT/EP03/02788, filed on Mar. 18, 2003.

(30) Foreign Application Priority Data

May 10, 2002 (DE) ..... 102 20 687

(51) Int. Cl.
*F01L 1/34* (2006.01)

(52) U.S. Cl. ..... 123/90.17; 123/90.11

(58) Field of Classification Search ..... 123/90.16, 123/90.17, 90.18, 90.15, 90.27, 90.31, 90.11; 251/129.01

See application file for complete search history.

(56) References Cited

U.S. PATENT DOCUMENTS

| | | | | |
|---|---|---|---|---|
| 2,860,528 | A * | 11/1958 | Butterfield et al. | 475/155 |
| 3,978,829 | A | 9/1976 | Takahashi et al. | |
| 4,694,653 | A * | 9/1987 | Kawamura | 60/597 |
| 5,303,616 | A * | 4/1994 | Palansky et al. | 477/63 |
| 5,381,764 | A | 1/1995 | Fukuma et al. | |
| 5,680,837 | A * | 10/1997 | Pierik | 123/90.17 |
| 5,979,382 | A | 11/1999 | Heer | |
| 6,138,622 | A | 10/2000 | Heer | |
| 6,216,654 | B1 * | 4/2001 | Regueiro | 123/90.15 |
| 6,257,186 | B1 | 7/2001 | Heer | |
| 6,457,446 | B1 * | 10/2002 | Willmot | 123/90.17 |
| 2001/0020460 | A1 | 9/2001 | Heer | |

FOREIGN PATENT DOCUMENTS

| | | |
|---|---|---|
| DE | 41 01 676 | 7/1992 |
| DE | 41 10 195 | 10/1992 |
| DE | 101 12 048 | 9/2001 |

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

The invention relates to a device for releasably connecting and adjusting the positions between a crankshaft and a cam shaft of an internal combustion engine, which includes a setting gear (1) configured as a three-shaft gear, which has a drive shaft (4) connected to the crankshaft, an output shaft (5) connected to the camshaft, and an adjusting shaft connected to an electric adjusting motor (2). A stationary transmission ratio $i_o$, which has a base or emergency running position, is present between the drive and output shafts when the adjusting shaft (6) is idle, the magnitude of the gear transmission ratio determining the gear type (positive or negative) and the direction of adjustment of the camshaft (3). Functional safety of the device is improved due to the fact that the base or emergency running position of the camshaft (3) can be reached and maintained in case of an outage or failure of the adjusting motor (2) and/or the control thereof be a slow-down or arresting of the adjusting shaft (6), simultaneous rotation of the drive shaft (4), and an appropriate gear transmission ratio.

7 Claims, 1 Drawing Sheet

CAMSHAFT ADJUSTER WITH AN ELECTRICAL DRIVE

CROSS-REFERENCE TO RELATED APPLICATIONS

This application is a continuation of PCT/EP03/02788, filed Mar. 18, 2003, which is incorporated herein by reference as if fully set forth.

BACKGROUND

The invention relates to a device for releasably connecting and adjusting the camshaft and the crankshaft of an internal combustion engine, having an adjusting gear created as a three shaft transmission, which has a drive shaft connected with the crankshaft, an output shaft connected with the camshaft, and an adjusting shaft connected with an electric adjusting motor, in which there is a gear transmission ratio $i_o$ between the drive shaft and the output shaft when the adjusting shaft is at rest, and the magnitude of the gear transmission ratio is determined by the gear type and the direction of setting of the camshaft, which has a base or emergency running position.

To ensure a secure starting in motion of an internal combustion engine with a hydraulic and electrical adjusting system for the camshaft, the camshaft must find itself in a so-called base or emergency running position. This position usually lies with the inlet camshafts in a "late", and the outlet camshafts in "early" positions. In normally functioning vehicles, the camshaft is set to the base position by turning off the motor and then fixing and locking it.

A conventional, hydraulically activated rotating piston adjuster, in the form of pivoting vanes or segment wings has a locking device. This unit fixes the hydraulic adjuster in its base position until it collects enough oil pressure to be able to set the camshaft. If an engine stall occurs, the camshaft can be in an undefined position outside the base position.

For hydraulic camshaft adjusting systems with a base position that is "late", during the next starting of the internal combustion engine, when the oil pressure is not sufficient because of the friction moment of the camshaft, which works in the opposite direction, the camshaft is set automatically to the late base position. If the base position is "early", when the oil pressure is not sufficient, the camshaft must be adjusted against the friction moment of camshaft to the early base position. This happens mostly through the use of a compensating spring, which creates the same but opposite moment to the camshaft friction moment.

These methods, common for hydraulically driven camshaft adjusters to achieve the base position after stalling an internal combustion engine, cannot be applied for electrically driven camshaft adjusters. They are also not necessary as long as the system of adjusting the motor is intact and can adjust the camshaft to the base position when an internal combustion engine is at rest or is started again. But in case of electric adjusting systems, the adjusting motor and/or its controlling system can fail and therewith impede the reaching of the base position.

There is a device described in DE 41 10 195 A1 for releasably connecting and adjusting the camshaft and the crankshaft of an internal combustion engine with an adjusting gear created as a three shaft transmission, which has a drive shaft connected with the crankshaft, a drive shaft connected with the camshaft, and an adjusting shaft connected with an electric adjusting motor, whereas there is a gear transmission ratio $i_o$ between the drive shaft and the output shaft when the adjusting shaft is at rest, and magnitude of the gear transmission ratio is determined by the type of gear (minus or plus gear) and the adjusting direction of camshafts, that have a base or emergency running position.

In this adjusting device the goal is an easy working and precise adjusting of the camshaft position. In order to maintain at least a basic functioning of the internal combustion engine, when the adjusting motor's system fails, it is designed as a limitation of the setting angle. Nevertheless, there is no indication in such a case when the base or emergency running position is reached.

SUMMARY

The invention is directed to the objective of creating an electrical camshaft adjuster, in which the camshaft can be adjusted to the base position even in the case of a failure of the adjusting motor and/or its controlling system. The object is solved according to the invention in that when the adjusting motor or its controlling system fail, the base or emergency running position of camshaft can be reached and maintained by means of braking or setting the adjusting shaft and rotation of drive shaft, as well as through the us of a suitable gear transmission ratio $i_o$. After having slowed down or fixed the adjusting shaft, the camshaft will be adjusted to the base or emergency running position by means of turning the drive shaft in low idle speed of the internal combustion engine or—if it stalled—during re-starting, even if the system of the adjusting motor has failed. In this position the vehicle can be started and operated with some limitations so that a repair shop can be reached. A precondition here is a suitable gear transmission ratio $i_o$, by means of which the desired gear type (plus or minus gear) and the adjusting direction (late or early) are determined.

When selecting the setting gear, the minus and plus gears come into question. Minus gears have a gear transmission ratio smaller than 0, whereas plus gears have a ratio higher than 0. When the gear transmission ratio $i_o$ is positive, the drive shaft and output shaft have the same turning direction, when the gear transmission ratio $i_o$ is negative, they have an opposite turning direction compared with a standing adjusting shaft and components connected therewith.

When in the case of a minus gear on the adjusting shaft, the drive shaft rotates clockwise so the output shaft and the camshaft connected with it rotate counter-clockwise, which corresponds to a late adjusting.

When in the case of a plus gear with a gear transmission ratio $i_o>1$ for the adjusting shaft, when the drive shaft is turned clockwise, the output drive rotates slower than the drive shaft, i.e. counter-clockwise and therewith in direction of late adjusting.

When in the case of a plus gear with a gear transmission ratio $0<i_o<1$ on the adjusting shaft and the drive shaft is rotating clockwise, the output drive rotates faster than the drive shaft, i.e. clockwise and therewith in the direction of early adjusting.

These relations are applicable to all setting gears in question. In summary, when an adjusting motor fails, in order to achieve a late base position it is necessary to set the adjusting shaft with a minus gear to $i_o<0$ or a plus gear with $i_o>1$, and to achieve an early base position it is necessary to set the adjusting shaft with a plus gear with $0<i_o<1$.

It is advantageous if the adjusting motor has a permanent magnet rotor with a passive holding torque that builds to a maximum in both directions of rotation from a middle position, and then again goes down. The holding torque of the adjusting motor, increased by the changed friction moment of setting gear, must have only 60%–100% of the changed, maximum, dynamic camshaft torque, that reacts upon the adjusting shaft, because the energy content of the peaks of camshaft torque is small, and the necessary holding torque is more determined by the middle camshaft torque. The usage of a permanent magnet rotor compared with a permanent magnet stator has this advantage that power must be fed only into the stator fixed to the cylinder head.

In the case that the holding torque is not sufficient in an adjusting motor with a permanent magnet, and in the case of separately excited direct current motors without holding torque, to set the adjusting shift, an additional braking torque is used. This is created with a cylinder head brake, preferably mechanical, or an eddy current brake. The brakes are automatically set in motion with the lowest idle speed of the internal combustion engine, and automatically loosened with a working adjusting motor. This way the camshafts are always set in the base position before the internal combustion engine is stopped. If this is not possible because the motor was stalled, it will be made up for with the next start.

It was also advantageous when the adjusting velocity of the camshaft, because of the chosen gear transmission ratio $i_o$ with a standing adjusting shaft and low idle speed of the internal combustion engine is set preferentially between 30° and 60° of a cam angle per second. Here it is not important if the adjusting motor, when the camshaft is put back into the base position, is set into one or two directions of rotation.

It is necessary that in the regular position of camshaft that the drive shaft, the output shaft, and the adjusting shaft for the setting gear turn with the same number of revolutions. In this way there is no relative movement between the crankshaft and the camshafts.

For adjusting gears, for example, known eccentric gear or shaft gear (plus gear) or wobble gear or two planet gear (minus or plus gear) can be used, and the adjusting motors are designed as conventional brushless motors with a permanent magnet rotor or as separately excited direct current motors with brushes.

BRIEF DESCRIPTION OF DRAWINGS

Further features of the invention will be understood from the following description and drawings, in which an exemplary embodiment of the invention is schematically presented. In the drawings.

DETAILED DESCRIPTION OF THE PREFERRED EMBODIMENTS

Figure 1:
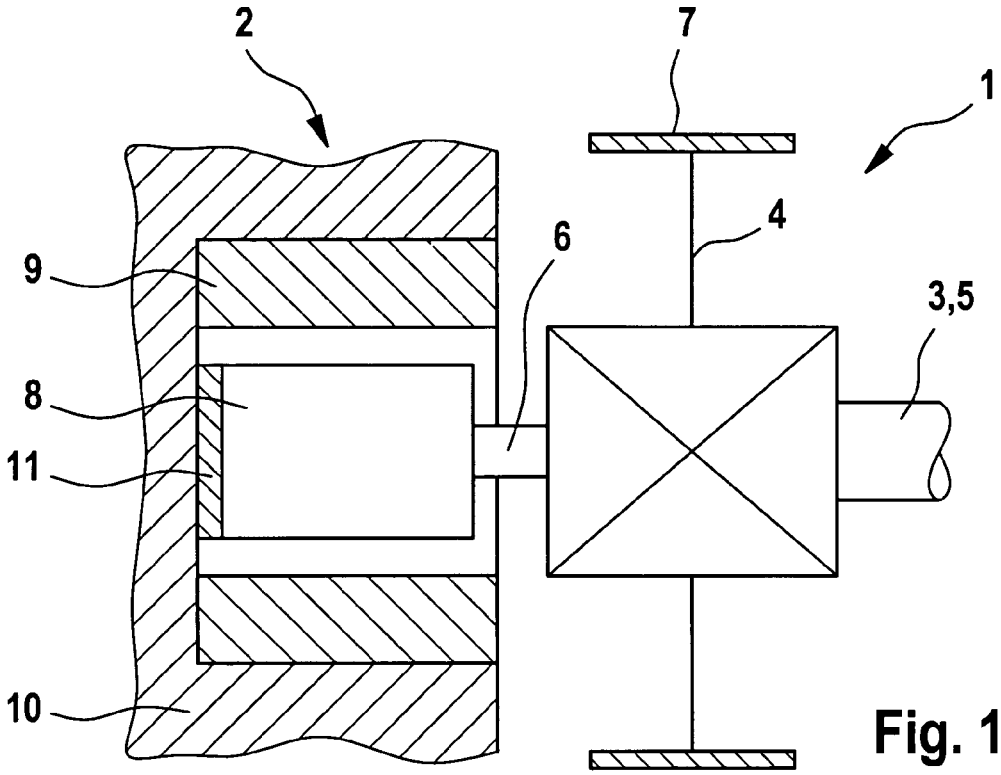
FIG. 1 is a view of a setting gear with an adjusting motor, whose stator is connected with cylinder head.
Figure 2:
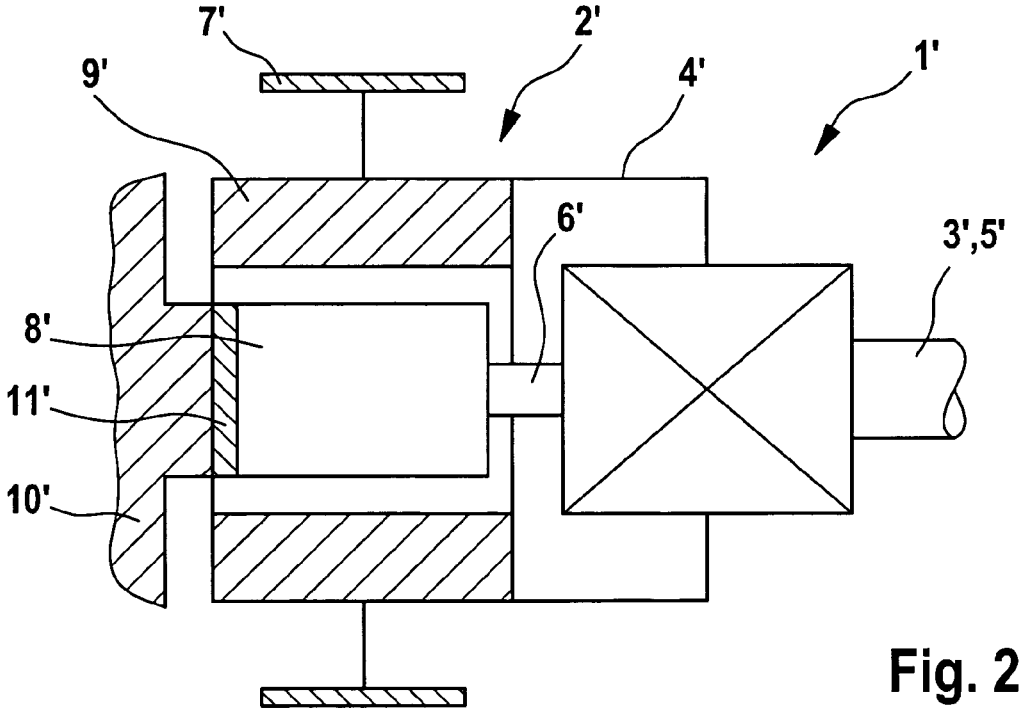
FIG. 2 is a view of a different setting gear with a different adjusting motor which rotates with the stator.

In FIGS. 1 and 2, setting gears 1, 1' with electrical adjusting motors 2, 2' are shown, which are used to adjust the position of the rotation angle between a crankshaft (not shown) and camshaft 3, 3' of an internal combustion engine.

The setting gear 1, 1' is configured as a three shaft transmission, which has a drive shaft 4, 4', an output shaft 5, 5', and an adjusting shaft 6, 6'.

The drive shaft 4, 4' is fixedly connected with a drive gear 7, 7', and through that is connected with the crankshaft by means of a not shown gearwheel, or a tooth belt, or a toothed chain.

The output shaft 5, 5' is fixedly connected with the camshaft 3, 3', and the adjusting shaft 6, 6' is connected with the rotor 8, 8' of the adjusting motor 2, 2'.

The stator 9 of the adjusting motor 2 is fixedly connected with the cylinder head 10 and is at rest. The stator 9' of the adjusting motor 2' is fixedly connected with the drive gear 7' and rotates with the setting gear with half of the crankshaft rotation speed.

The camshaft 3, 3' has a base or emergency running position, which must be achieved for a secure starting and a restricted operation. This is possible without problems with an intact adjusting motor 2, 2' even after the internal combustion engine stalls, because the adjusting motor 2, 2' repositions the camshaft 3, 3' at stalling of the internal combustion engine or during a new starting. But a new starting must be possible even with a failure of the adjusting motor 2, 2' in order to reach a repair shop at least.

The adjusting gears 1, 1' and their gear transmission ratio $i_o$ are constructed in such a way, that by means of a mere setting of adjusting shafts 6, 6' the camshafts 3, 3', when starting, come to their base position and therewith the internal combustion engine can still be started.

When the adjusting shaft 6, 6' remains at rest and the drive shaft turns to the right 4, 4' the following must be explained about $i_o$:

When $i_o<0$ there is a minus gear with a late advance; when $0<i_o<1$, there is a plus gear with an early advance, and when $i_o>1$, there is a plus gear with a late advance.

Setting of an adjusting shaft can happen by means of an unpowered adjusting motor 2 with a permanent magnet rotor 8 or permanent magnet stator 9. The adjusting motor 2 exhibits a holding torque that grows from a middle position in both directions of rotation until a maximum is reached, and then drops down again. The holding torque is the maximum torque with which a non-excited adjusting motor can be statically loaded, without having caused a non-constant but continual rotation.

The holding torque is strengthened by the changed friction moment of setting gear 1 to the rest moment, which should lie between 60% and 100% of the changed maximum, dynamic camshaft moment at low idle speed of the internal combustion engine.

If the rest moment of the unpowered adjusting motor 2 is not sufficient for setting the adjusting shaft, an additional brake moment will be provided by a mechanical or electric brake connected to the cylinder head. This acts like the rest moment in both directions of rotation of the adjusting shaft 6.

After the internal combustion engine is stalled or the adjusting motor 2 has failed, the camshaft 3 can find itself in an undefined position. By means of setting or braking of the adjusting shaft 6, the camshaft 3 is set to its base position during the subsequent starting by means of the rotational movement of drive shaft 4 caused by the starter, so that a start is possible.

Since the stator 9' of adjusting motor 2' (see FIG. 2) rotates with its rotor 8', a setting of adjusting shaft 6' through the holding torque active between stator 9' and rotor 6' is not possible. In this case the adjusting shaft 6' can be stopped only with a mechanical or electric brake 11' connected to the cylinder head. With this, after the internal combustion engine has stalled or the adjusting motor 2' has failed, it is possible, at the latest when the next time motor is set in motion, to set the camshaft 3' to its base position and make it possible to start the motor.

When the adjusting motors 2, 2' have high temperatures, the mechanical or electrical braking of adjusting shafts 6, 6' is also used for thermal relief of the adjusting motors 2, 2'.

LIST OF REFERENCE NUMBERS

1 Setting gear
1' Set ting gear
2 Electric adjusting motor
2' Electric adjusting motor
3 Camshaft
3' Camshaft
4 Drive shaft
4' Drive shaft
5 Output shaft
5' Output shaft
6 Adjusting shaft
6' Adjusting shaft
7 Drive wheel
7' Drive wheel
8 Rotor
8' Rotor
9 Stator
9' Stator
10 Cylinder head
10' Cylinder head
11 Brake with cylinder head
11' Brake with cylinder head

The invention claimed is:

1. A device for releasably connecting and adjusting a camshaft (3, 3') and a crankshaft of an internal combustion engine, comprising an adjusting gear (1, 1') formed as a three shaft transmission, which has a drive shaft (4, 4') connected with the crankshaft, an output shaft (5, 5') connected with the camshaft, and an adjusting shaft (6, 6') connected with an electric adjusting motor (2, 2'), a gear transmission ratio $i_o$ is defined between the drive shaft and the output shaft (4, 4'; 5, 5') when the adjusting shaft (6, 6') is at rest, and a magnitude of the gear transmission ratio is determined by a gear type and a direction of setting of camshaft (3, 3'), which has a base or emergency running position, wherein upon a failure of the adjusting motor (2, 2') or a controlling system, the base or emergency running position of camshaft (3, 3') can be reached and maintained by one of braking or setting the adjusting shaft (6, 6'), and rotation of drive shaft (4, 4'), as well as the gear transmission ratio $i_o$;

wherein for a late adjustment of camshaft (3, 3') a minus gear with $i_o<0$ or a plus gear with $i_o>1$ is provided, and for an early adjustment of camshaft (3, 3') a plus gear with $0<i_o<1$ is provided;

wherein the adjusting motor (2) includes a rotor (8) and a stator fixedly connected to a cylinder head, the rotor (8) includes a permanent magnet, and for a power free setting of the adjusting shaft (6) a holding torque of the adjusting motor is utilized; and at least a provisional functioning of the internal combustion engine is possible by a corresponding setting of the adjusting motor (2) and through increasing of the holding torque by a changed friction moment of adjusting gear (1) from 60% to 100% of the changed, maximum, dynamic camshaft torque, which reacts upon the adjusting shaft (6), when starting and with low idle speed.

2. The device according to claim 1, wherein when the holding torque of the adjusting motor (2, 2') is not sufficient or not present, for setting the adjusting shaft, the external braking torque of a mechanical or electric brake fixed (11, 11') to a cylinder head of the internal combustion engine is provided.

3. The device according to claim 2, the brakes (11, 11') are automatically activated at a low idle speed of the internal combustion engine, and automatically released with working adjusting motor (2, 2').

4. The device according to claim 3, wherein a rate of change of camshaft (3, 3'), because of a selected gear transmission ratio $i_o$ for the adjusting shaft (6, 6') and low idle speed of the internal combustion engine amounts to between about 30° and about 60° of cam angle per second.

5. The device according to claim 4, wherein a reset of camshaft (3, 3') to the base or emergency running position takes place independently from a direction of rotation of the adjusting motor (2, 2').

6. The device according to claim 5, wherein in a normal position of the camshaft (3, 3'), the drive shaft, the output shaft, and the adjusting shaft (4, 4'; 5, 5'; 6, 6') of the adjusting gear rotate with the same number of revolutions.

7. The device according to claim 6, wherein the adjusting gear (1, 1') comprises at least one of an eccentric gear, shaft gear (plus gear), a wobble gear or a two planet gear (minus or plus gear), and the adjusting motor (2, 2') comprises a direct current motor with or without brushes.

* * * * *